US012472551B2

(12) United States Patent
Tao et al.

(10) Patent No.: US 12,472,551 B2
(45) Date of Patent: Nov. 18, 2025

(54) CABLE BENDING SYSTEM

(71) Applicants: Tyco Electronics (Shanghai) Co. Ltd., Shanghai (CN); TE Connectivity Services GmbH, Schaffhausen (CH)

(72) Inventors: Zongjie Tao, Shanghai (CN); Jian Cao, Shanghai (CN); Lvhai Hu, Shanghai (CN); Dandan Zhang, Shanghai (CN); Roberto Francisco-Yi Lu, Bellevue, WA (US)

(73) Assignees: TE Connectivity Solutions GmbH, Schaffhausen (CH); Tyco Electronics (Shanghai) Co., Ltd., Shanghai (CN)

( * ) Notice: Subject to any disclaimer, the term of this patent is extended or adjusted under 35 U.S.C. 154(b) by 154 days.

(21) Appl. No.: 17/382,807

(22) Filed: Jul. 22, 2021

(65) Prior Publication Data

US 2022/0023932 A1 Jan. 27, 2022

(30) Foreign Application Priority Data

Jul. 23, 2020 (CN) ..... 202010718065.5

(51) Int. Cl.
*B21F 1/00* (2006.01)
*B21D 11/07* (2006.01)
(Continued)

(52) U.S. Cl.
CPC ..... *B21F 1/004* (2013.01); *B21D 11/07* (2013.01); *B21D 11/18* (2013.01); *B21D 13/02* (2013.01); *B21F 1/04* (2013.01)

(58) Field of Classification Search
CPC ..... B21D 11/07; B21D 11/18; B21D 13/02; B21D 13/10; B21D 43/003; B21F 1/004; B21F 1/04
See application file for complete search history.

(56) References Cited

U.S. PATENT DOCUMENTS 3,628,369 A * 12/1971 Williamson ..... B21D 11/07 72/385
3,722,254 A * 3/1973 Katogir ..... B21D 11/07 72/383

(Continued)

FOREIGN PATENT DOCUMENTS

CN 101875074 A 11/2010
CN 103817268 B * 1/2015 ..... B21F 1/04

(Continued)

OTHER PUBLICATIONS

First Office Action from the National Intellectual Property Office of China dated Mar. 22, 2023 with English translation thereof, corresponding to Application No. 2020107180655, 12 pages.

*Primary Examiner* — Jared O Brown
*Assistant Examiner* — Matthew Stephens
(74) *Attorney, Agent, or Firm* — Barley Snyder

(57) ABSTRACT

A cable bending system comprises at least one bending module. The bending module includes an active actuator having a first body, and an active rod mounted in the first body. The active rod is movable in a first direction perpendicular to an axial direction of a cable to be bent. A passive actuator of the bending module includes a second body connected to the first body and defines a shaping cavity open to the active rod. The active rod pushes a portion of the cable into the shaping cavity of the second body in the first direction for bending the portion of the cable.

13 Claims, 2 Drawing Sheets

(51) Int. Cl.

| | |
|---|---|
| ***B21D 11/18*** | (2006.01) |
| ***B21D 13/02*** | (2006.01) |
| ***B21F 1/04*** | (2006.01) |

(56) References Cited

U.S. PATENT DOCUMENTS

| | | | | | |
|---|---|---|---|---|---|
| 3,842,648 | A | * | 10/1974 | Schwartz | B21D 11/07 72/283 |
| 3,978,706 | A | * | 9/1976 | Nakagawa | B21D 7/06 72/389 |
| 4,708,009 | A | * | 11/1987 | Post | B21F 1/00 72/472 |
| 8,341,998 | B2 | | 1/2013 | Saito et al. | |
| 2007/0277899 | A1 | * | 12/2007 | Neet | H02K 15/0421 140/105 |
| 2010/0275671 | A1 | * | 11/2010 | Saito | B21D 13/02 72/356 |
| 2022/0023932 | A1 | | 1/2022 | Tao et al. | |

FOREIGN PATENT DOCUMENTS

| | | | | | |
|---|---|---|---|---|---|
| CN | 208083255 | U | | 11/2018 | |
| CN | 209886550 | U | | 1/2020 | |
| FR | 2223099 | A1 | * | 10/1974 | B21D 11/07 |
| JP | 2010260061 | A | | 11/2010 | |

* cited by examiner

CABLE BENDING SYSTEM

CROSS-REFERENCE TO RELATED APPLICATIONS

This application claims priority under 35 U.S.C. § 119 to Chinese Patent Application No. 202010718065.5, filed Jul. 23, 2020, the entire disclosure of which is incorporated herein by reference.

FIELD OF THE INVENTION

The present disclosure relates to a cable bending system, and more particularly, to a system for simultaneously forming a plurality of bends in an electrical cable.

BACKGROUND

Electrical systems often include components connected via flexible electrical cables or wires. During manufacturing of these systems, the cables or wires must be routed within the system environment, which may include the formation of multiple bends in the cable for matching its shape to, for example, a target circuit board or other feature. In the prior art, these bending processes are generally performed manually, particularly when a distance between bending points in the horizontal direction of the cable changes or is otherwise irregular. These manual operations, however, are time consuming, and thus inefficient.

Accordingly, there is a need for improved systems and methods for performing cable bending operations, particularly in applications requiring multiple bends spaced at irregular intervals.

SUMMARY

According to an embodiment of the present disclosure, a cable bending system comprises at least one bending module. The bending module includes an active actuator having a first body, and an active rod mounted on the first body. The active rod is movable in a first direction perpendicular to an axial direction of a cable to be bent. A passive actuator of the bending module includes a second body connected to the first body and defines a shaping cavity open to the active rod. The active rod pushes a portion of the cable into the shaping cavity of the second body in the first direction for bending the portion of the cable.

BRIEF DESCRIPTION OF THE DRAWINGS

The invention will now be described by way of example with reference to the accompanying Figures, of which.

DETAILED DESCRIPTION OF THE EMBODIMENTS

Figure 1:
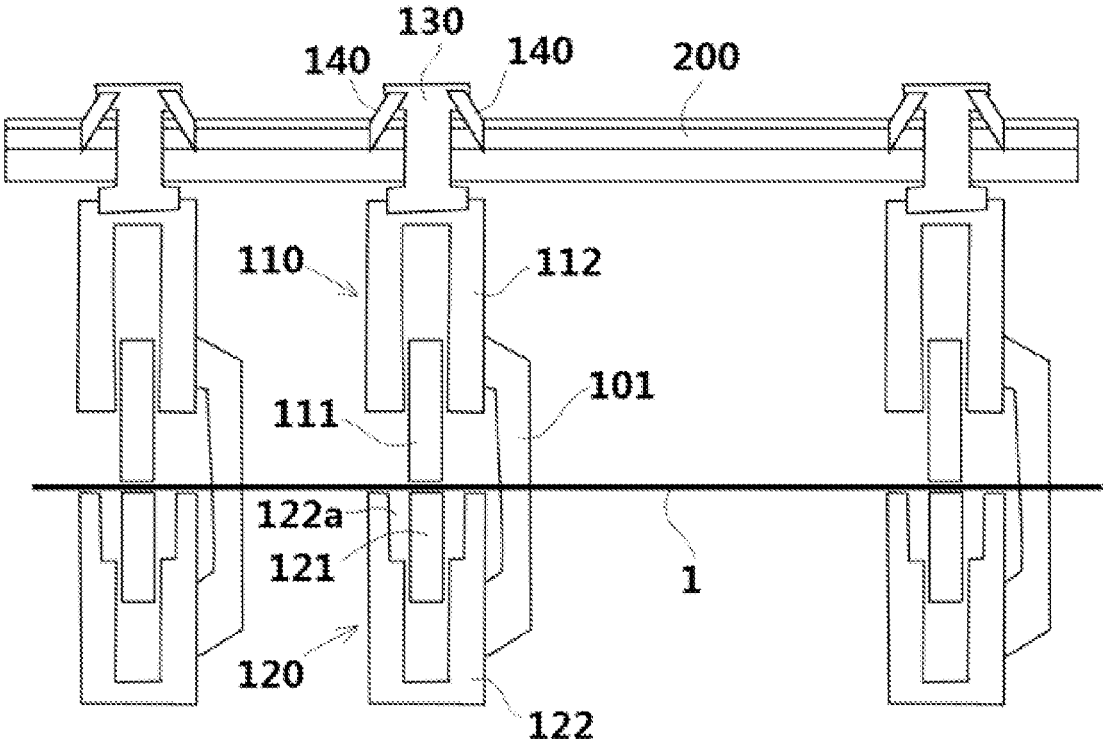
FIG. 1 is a schematic diagram of a cable bending system according to an exemplary embodiment of the present disclosure in which a cable has not been bent.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a cable bending system comprises at least one bending module. Each bending module includes an active actuator having a first body and an active rod mounted thereon. The active rod is movable in a first direction perpendicular to an axial direction of the cable to be bent. The bending module further includes a passive actuator having a second body fixedly or rigidly connected to the first body and formed with a shaping cavity open to the active rod. The active rod is adapted to push a portion of the cable to be bent into the shaping cavity of the second body in the first direction.

Figure 2:
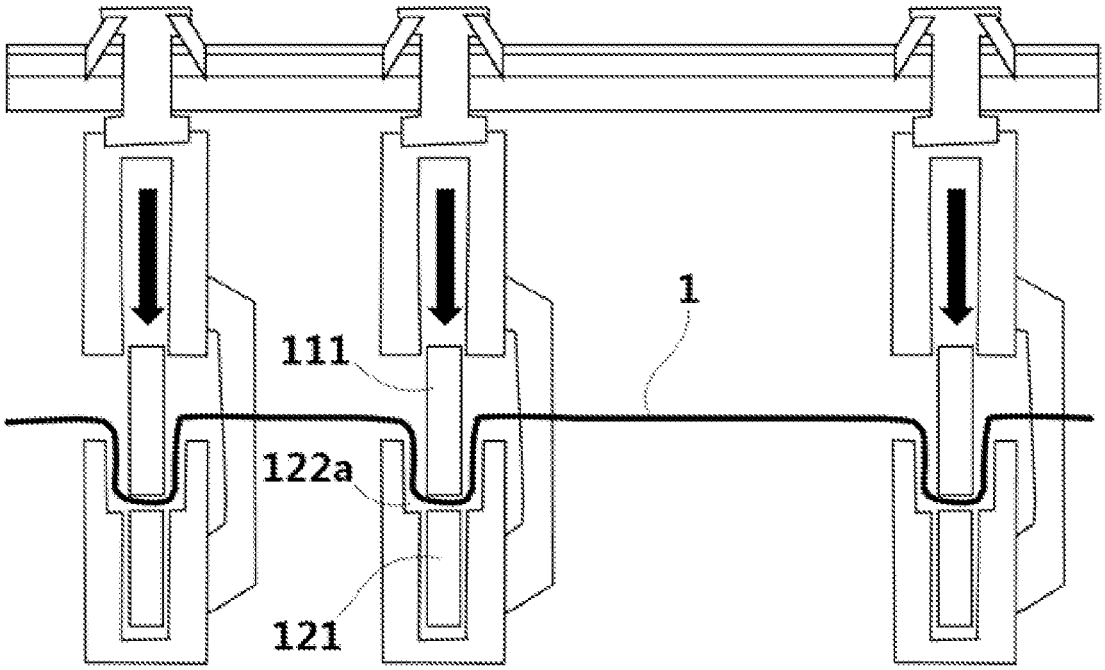
FIG. 2 is a schematic diagram of a cable bending system according to an exemplary embodiment of the present disclosure in which the cable has been bent.

FIG. 1 shows a schematic diagram of a cable bending system according to an exemplary embodiment of the present disclosure in which a cable 1 has not been bent. FIG. 2 shows a schematic diagram of a cable bending system according to an exemplary embodiment of the present disclosure in which the cable 1 has been bent.

In the illustrated embodiment, as shown in FIGS. 1 and 2, the cable bending system comprises at least one bending module (110, 120, 130, 140). Each bending module (110, 120, 130, 140) generally includes an active actuator 110 and a passive actuator 120. The active actuator 110 comprises a first body 112 and an active rod 111 mounted on or in the first body 112. The active rod 111 is movable in a first direction perpendicular to an axial direction of the cable 1 to be bent. The passive actuator 120 comprises a second body 122 connected to the first body 112 and formed with a shaping cavity 122*a* open to the active rod 111.

In the illustrated embodiment, as shown in FIGS. 1 and 2, the active rod 111 is adapted to push a part of the cable 1 into the shaping cavity 122*a* of the second body 122 in the first direction for bending the part of the cable 1.

In the illustrated embodiment, as shown in FIGS. 1 and 2, a moving distance of the active rod 111 in the first direction is selectively controllable such that a depth to which the cable 1 is pushed into the shaping cavity 122 of the second body 122 may be altered or controlled by controlling the active rod 111.

In the illustrated embodiment, as shown in FIGS. 1 and 2, the active rod 111 is located in the middle of an opening of the shaping cavity 122*a* of the second body 122 such that the resulting bent part of the cable 1 has a symmetrical structure or shape.

In the illustrated embodiment, as shown in FIGS. 1 and 2, the first body 112 and the second body 122 are connected and fixed together by a connecting bridge 101. The connecting bridge 101 is bent or offset in a direction away from the cable 1 to allow the cable 1 to pass linearly between the first body 112 and the second body 122.

In the illustrated embodiment, as shown in FIGS. 1 and 2, the passive actuator 120 further comprises a driven rod 121 mounted in or on the second body 122, the driven rod 121 being aligned with the active rod 111 and being movable in the first direction under a pushing force of the active rod 111.

In the illustrated embodiment, as shown in FIGS. 1 and 2, the cable 1 is clamped between the driving rod 111 and the driven rod 121 during bending of the cable 1.

In the illustrated embodiment, as shown in FIGS. 1 and 2, the cable bending system further comprises a slide rail 200 extending in a second direction, a horizontal direction in the exemplary figures, and parallel to the axial direction of the cable 1 to be bent. Each bending module (110, 120, 130, 140) is slidably mounted on the slide rail 200 and is movable along the slide rail 200 such that a bending position of each bending module (110, 120, 130, 140) in the second direction is adjustable.

In the illustrated embodiment, as shown in FIGS. 1 and 2, each bending module (110, 120, 130, 140) further comprises a slider 130 slidably mounted on the slide rail 200. One of the first body 112 and the second body 122 is connected and fixed to the slider 130. In the illustrated embodiment, as shown in FIGS. 1 and 2, the first body 112 is connected and fixed to the slider 130, and the second body 122 is suspended below the first body 112.

In the illustrated embodiment, as shown in FIGS. 1 and 2, each bending module (110, 120, 130, 140) further comprises a locking device 140 mounted on the slider 130, the locking device 140 including a plurality of arms engaging with the slide rail 200 for locking the slider 130 on the slide rail 200 so as to lock the bending module (110, 120, 130, 140) in a predetermined bending position.

In the illustrated embodiment, as shown in FIGS. 1 and 2, the cable bending system comprises a plurality of bending modules (110, 120, 130, 140) being slidably mounted on the slide rail 200, respectively, such that a plurality of parts of the cable 1 can be bent simultaneously.

In the illustrated embodiment, as shown in FIGS. 1 and 2, the active actuator 110 and the passive actuator 120 are pneumatic cylinders, hydraulic cylinders or electric cylinders, the first body 112 and the second body 122 are cylinder bodies, and the active rod 111 and the driven rod 121 are actuator rods being movable relative to the cylinder bodies.

In the illustrated embodiment, as shown in FIGS. 1 and 2, the driven rod 121 is elastically floating, and may be automatically elastically reset to its initial position after being separated from the active rod 111.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A cable bending system, comprising:

a slide rail; and a plurality of bending modules, each including:

an active actuator having a first body, and an active rod mounted in the first body and configured to move in a first direction along an axis, the active rod having a flat surface perpendicular to the axis;

a passive actuator having a second body connected to and spaced a fixed distance from the first body by a connecting bridge, the second body defining a shaping cavity for receiving the active rod, the shaping cavity having at least two bending surfaces perpendicular to the axis and the passive actuator further comprising a driven rod having a flat surface perpendicular to the axis and movably disposed within the shaping cavity, the driven rod aligned with the axis of the active rod and configured to move in the first direction under a force of the active rod, wherein the active rod is configured to move in the first direction and clamps the cable against the driven rod and the active rod, the driven rod and the cable together are moved into the shaping cavity, whereby a portion of the cable is bent over the bending surfaces with the bending surfaces positioned perpendicular to the axis, the at least two bending surfaces of the shaping cavity that are perpendicular to the axis are fixed relative to the second body, the slide rail extending in a second direction parallel to the axial direction of the cable to be bent; and a slider slidably mounted on the slide rail, the first body is connected and fixed to the slider and the second body is suspended below the first body, the plurality of bending modules are each slidably mounted on the slide rail by the slider of each of the bending modules and are all independently slidable with respect to one another along the slide rail, such that a bending position of each of the plurality of bending modules is independently adjustable in the second direction.

2. The cable bending system according to claim 1, wherein a moving distance of the active rod in the first direction is controllable such that a depth to which the cable is pushed into the shaping cavity of the second body may be selectively altered.

3. The cable bending system according to claim 1, wherein the active rod is disposed in a middle of an opening of the shaping cavity and is configured to be moved into an extended position wherein at least a portion of the rod is located in a central portion of an opening of the shaping cavity.

4. The cable bending system according to claim 1, wherein each of the plurality of bending modules further comprises a locking device mounted on the slider.

5. The cable bending system according to claim 1, wherein a plurality of portions of the cable are bent simultaneously by the plurality of bending modules.

6. The cable bending system according to claim 1, wherein the active rod and the driven rod are configured to clamp the cable during bending.

7. The cable bending system according to claim 6, wherein the active actuator and the passive actuator are pneumatic cylinders, hydraulic cylinders, or electric cylinders, the first body and the second body are cylinder bodies, and the active rod and the driven rod are actuator rods movable relative to the cylinder bodies.

8. The cable bending system according to claim 6, wherein the driven rod is elastically floating and adapted to automatically reset to an initial position after being separated from the active rod.

9. A cable bending system, comprising:

a slide rail;

a plurality of bending modules slidably mounted on the slide rail, each bending module including:

an active actuator including a first body and an active rod mounted in the first body and movable along an axis;

a second body fixedly connected to the first body and defining a shaping cavity open to the active rod, the shaping cavity having at least two bending surfaces perpendicular to the axis and the second body further comprising a driven rod movably disposed within the shaping cavity, the driven rod aligned with the first axis and configured to move together with the active rod and a cable in a first direction into the shaping cavity under a force of the active rod, a portion of the cable is bent over the bending surfaces with the bending surfaces positioned perpendicular to the axis, the at least two bending surfaces of the shaping cavity that are perpendicular to the axis are fixed relative to the second body; and a slider slidably mounted on the slide rail, the first body is connected and fixed to the slider and the second body is suspended below the first body, the plurality of bending modules are each slidably mounted on the slide rail by the slider of each of the bending modules and are all independently slidable with respect to one another along the slide rail, such that a bending position of each of the plurality of bending modules is independently adjustable in a second direction of the slide rail.

10. The cable bending system according to claim 9, wherein the second body includes a passive actuator, the passive actuator connected to the driven rod mounted in the second body and opposing the active rod.

11. The cable bending system according to claim 10, wherein the driven rod is elastically floating and adapted to automatically reset to an initial position after being separated from the active rod.

12. The cable bending system according to claim 9, wherein each bending module further comprises a locking device mounted on the slider.

13. The cable bending system according to claim 9, wherein the first body and the second body are fixedly connected together by a connecting bridge, the connecting bridge being bent or offset in a direction away from the cable to allow the cable to be bent to pass between the first body and the second body.

* * * * *